US007464680B2

(12) United States Patent
Geyer et al.

(10) Patent No.: US 7,464,680 B2
(45) Date of Patent: Dec. 16, 2008

(54) SWITCHING ELEMENT FOR A VALVE TRAIN OF AN INTERNAL COMBUSTION ENGINE

(75) Inventors: Norbert Geyer, Höchstadt (DE); Peter Sailer, Erlangen (DE); Oliver Schnell, Veitsbronn (DE)

(73) Assignee: Ina-Schaeffler KG, Herzogenaurach (DE)

( * ) Notice: Subject to any disclaimer, the term of this patent is extended or adjusted under 35 U.S.C. 154(b) by 826 days.

(21) Appl. No.: 10/498,481

(22) PCT Filed: Jan. 15, 2003

(86) PCT No.: PCT/EP03/00307

§ 371 (c)(1),
(2), (4) Date: Jan. 27, 2005

(87) PCT Pub. No.: WO03/067038

PCT Pub. Date: Aug. 14, 2003

(65) Prior Publication Data

US 2005/0120989 A1 Jun. 9, 2005

Related U.S. Application Data

(60) Provisional application No. 60/354,628, filed on Feb. 6, 2002.

(30) Foreign Application Priority Data

Feb. 6, 2002 (DE) ..... 102 04 672

(51) Int. Cl.
*F01L 1/14* (2006.01)

(52) U.S. Cl. ..... 123/90.59; 123/90.55; 123/90.52; 123/90.5; 123/90.48

(58) Field of Classification Search ..... 123/90.59, 123/90.55
See application file for complete search history.

(56) References Cited

U.S. PATENT DOCUMENTS

| | | | | |
|---|---|---|---|---|
| 3,108,580 | A | 10/1963 | Crane | |
| 3,886,808 | A | 6/1975 | Weber | 74/569 |
| 4,054,109 | A | 10/1977 | Herrin et al. | 123/90.16 |
| 4,083,334 | A | 4/1978 | Roncon | 123/90.35 |
| 4,089,234 | A | 5/1978 | Henson et al. | 74/569 |

(Continued)

FOREIGN PATENT DOCUMENTS

DE 42 06 166 A1 9/1992

(Continued)

OTHER PUBLICATIONS

O. Schnell, "DaimlerChrysler 5.7L MDS Lifter", (on or about) Jan. 29, 2001, pp. 1-6.

(Continued)

*Primary Examiner*—Thomas E Denion
*Assistant Examiner*—Kyle M Riddle
(74) *Attorney, Agent, or Firm*—Fitzpatrick, Cella, Harper & Scinto

(57) ABSTRACT

The invention proposes a switching element (1) for a valve train of an internal combustion engine, particularly for valve deactivation, with a simple-to-implement measure for adjusting the coupling lash of its coupling means (8) in a receptacle (6) using two retaining rings (19, 20), one of which is stocked in a variety of thicknesses.

2 Claims, 1 Drawing Sheet

U.S. PATENT DOCUMENTS

| | | | | |
|---|---|---|---|---|
| 4,098,240 | A | 7/1978 | Abell | 123/90.55 |
| 4,133,332 | A | 1/1979 | Benson et al. | 123/198 F |
| 4,164,917 | A | 8/1979 | Glasson | 123/97 |
| 4,207,775 | A | 6/1980 | Lintott | 74/55 |
| 4,228,771 | A | 10/1980 | Krieg | 123/90.55 |
| 4,231,267 | A | 11/1980 | Van Slooten | 74/569 |
| 4,386,806 | A | 6/1983 | Axen et al. | 299/5 |
| 4,463,714 | A | 8/1984 | Nakamura | 123/90.57 |
| 4,546,734 | A | 10/1985 | Kodama | 123/90.16 |
| 4,576,128 | A | 3/1986 | Kenichi | 123/198 |
| 4,615,307 | A | 10/1986 | Kodama et al. | 123/90.16 |
| 4,739,675 | A | 4/1988 | Connell | 74/569 |
| 4,768,475 | A | 9/1988 | Ikemura | 123/90.16 |
| 4,790,274 | A | 12/1988 | Inoue et al. | 123/198 F |
| 4,905,639 | A | 3/1990 | Konno | 123/90.16 |
| 4,913,106 | A | 4/1990 | Rhoads | 123/90.49 |
| 4,941,438 | A | 7/1990 | Muto | 123/90.46 |
| 4,942,855 | A | 7/1990 | Muto | 123/90.33 |
| 5,085,182 | A | 2/1992 | Nakamura et al. | 123/90.16 |
| 5,088,455 | A | 2/1992 | Moretz | 123/90.5 |
| 5,090,364 | A | 2/1992 | McCarroll et al. | 123/90.16 |
| 5,099,806 | A | 3/1992 | Murata et al. | 123/90.16 |
| 5,245,958 | A | 9/1993 | Krieg et al. | 123/90.55 |
| 5,247,913 | A | 9/1993 | Manolis | 123/90.16 |
| 5,253,621 | A | 10/1993 | Dopson et al. | 123/90.16 |
| 5,255,639 | A | 10/1993 | Shirey et al. | 123/90.16 |
| 5,261,361 | A | 11/1993 | Speil | 123/90.22 |
| 5,307,769 | A | 5/1994 | Meagher et al. | 123/90.5 |
| 5,345,904 | A | 9/1994 | Dopson et al. | 123/198 F |
| 5,351,662 | A | 10/1994 | Dopson et al. | 123/90.16 |
| 5,357,916 | A | 10/1994 | Matterazzo | 123/90.16 |
| 5,361,733 | A | 11/1994 | Spath et al. | 123/90.16 |
| 5,398,648 | A | 3/1995 | Spath et al. | 123/90.16 |
| 5,402,756 | A | 4/1995 | Bohme et al. | 123/90.16 |
| 5,419,290 | A | 5/1995 | Hurr et al. | 123/90.16 |
| 5,429,079 | A | 7/1995 | Murata et al. | 123/90.16 |
| 5,431,133 | A | 7/1995 | Spath et al. | 123/90.16 |
| 5,501,186 | A | 3/1996 | Hara et al. | 123/90.16 |
| 5,544,626 | A | 8/1996 | Diggs et al. | 123/90.16 |
| 5,544,628 | A | 8/1996 | Voigt | 123/90.16 |
| 5,546,899 | A | 8/1996 | Sperling et al. | 123/90.5 |
| 5,555,861 | A | 9/1996 | Mayr et al. | 123/90.16 |
| 5,615,651 | A | 4/1997 | Miyachi | 123/198 F |
| 5,651,335 | A | 7/1997 | Elendt et al. | 123/90.16 |
| 5,655,487 | A | 8/1997 | Maas et al. | 123/90.16 |
| 5,660,153 | A | 8/1997 | Hampton et al. | 123/90.16 |
| 5,669,342 | A | 9/1997 | Speil | 123/90.16 |
| 5,682,848 | A | 11/1997 | Hampton et al. | 123/90.16 |
| 5,709,180 | A | 1/1998 | Spath | 123/90.16 |
| 5,720,244 | A | 2/1998 | Faria | 123/90.16 |
| 5,782,216 | A | 7/1998 | Haas et al. | 123/90.16 |
| 5,803,040 | A | 9/1998 | Biesinger et al. | 123/198 F |
| 5,832,884 | A | 11/1998 | Haas et al. | 123/90.16 |
| 5,875,748 | A | 3/1999 | Haas et al. | 123/90.16 |
| 5,893,344 | A | 4/1999 | Church | 123/90.16 |
| 5,934,232 | A | 8/1999 | Greene et al. | 123/90.16 |
| 6,032,643 | A | 3/2000 | Hosaka et al. | 123/321 |
| 6,039,017 | A | 3/2000 | Hendriksma | 123/90.43 |
| 6,053,133 | A | 4/2000 | Faria et al. | 123/90.16 |
| 6,076,491 | A | 6/2000 | Allen | 123/90.16 |
| 6,092,497 | A | 7/2000 | Preston et al. | 123/90.16 |
| 6,095,696 | A | 8/2000 | Földi | 385/79 |
| 6,164,255 | A | 12/2000 | Maas et al. | 123/90.16 |
| 6,196,175 | B1 | 3/2001 | Church | 123/90.16 |
| 6,196,176 | B1 | 3/2001 | Groh et al. | 123/90.16 |
| 6,213,076 | B1 | 4/2001 | Fischer et al. | 123/90.55 |
| 6,244,229 | B1 | 6/2001 | Nakano et al. | 123/90.15 |
| 6,247,433 | B1 | 6/2001 | Faria et al. | 123/90.16 |
| 6,257,185 | B1 | 7/2001 | Groh et al. | 123/90.16 |
| 6,273,039 | B1 | 8/2001 | Church | 123/90.16 |
| 6,318,324 | B1 | 11/2001 | Koeroghlian et al. | 123/90.55 |
| 6,321,704 | B1 | 11/2001 | Church et al. | 123/90.16 |
| 6,321,705 | B1 | 11/2001 | Fernandez et al. | 123/90.16 |
| 6,325,030 | B1 | 12/2001 | Spath et al. | 123/90.16 |
| 6,345,596 | B1 | 2/2002 | Kuhl | 123/90.16 |
| 6,405,699 | B1 | 6/2002 | Church | 123/90.5 |
| 6,412,460 | B1 | 7/2002 | Sato et al. | 123/90.16 |
| 6,427,652 | B2 | 8/2002 | Faria et al. | 123/90.16 |
| 6,439,176 | B1 | 8/2002 | Payne | 123/90.12 |
| 6,460,499 | B1 | 10/2002 | Mason et al. | 123/90.55 |
| 6,477,997 | B1 | 11/2002 | Wakeman | 123/90.16 |
| 6,497,207 | B2 | 12/2002 | Spath et al. | 123/90.16 |
| 6,513,470 | B1 | 2/2003 | Hendriksma et al. | 123/90.16 |
| 6,578,535 | B2 | 6/2003 | Spath et al. | 123/90.16 |
| 6,588,394 | B2 | 7/2003 | Zheng et al. | 123/198 F |
| 6,591,796 | B1 | 7/2003 | Scott | 123/90.13 |
| 6,595,174 | B2 | 7/2003 | Schnell | 123/90.55 |
| 6,606,972 | B2 | 8/2003 | Wenisch et al. | 123/90.17 |
| 6,615,783 | B2 | 9/2003 | Haas et al. | 123/90.48 |
| 6,655,487 | B2 | 12/2003 | Mallette et al. | 180/190 |
| 6,668,776 | B2 * | 12/2003 | Hendriksma et al. | 123/90.16 |
| 6,745,737 | B2 | 6/2004 | Evans et al. | 123/90.5 |
| 6,748,914 | B2 | 6/2004 | Spath et al. | 123/90.53 |
| 6,802,288 | B2 | 10/2004 | Spath | 123/90.16 |
| 6,814,040 | B2 | 11/2004 | Hendriksma et al. | 123/90.59 |
| 6,866,014 | B2 | 3/2005 | Spath | 123/90.5 |
| 6,920,857 | B2 | 7/2005 | Spath | 123/90.48 |
| 6,976,463 | B2 | 12/2005 | Spath et al. | 123/90.59 |
| 6,977,154 | B1 | 12/2005 | Choo et al. | 435/7.1 |
| 6,997,154 | B2 | 2/2006 | Geyer et al. | 123/90.44 |
| 7,007,651 | B2 | 3/2006 | Spath | 123/90.5 |
| 7,036,481 | B2 | 5/2006 | Sailer et al. | 123/198 F |
| 7,055,479 | B2 | 6/2006 | Sailer et al. | 123/90.59 |
| 7,146,951 | B2 | 12/2006 | Sailer et al. | 123/90.45 |
| 7,207,303 | B2 | 4/2007 | Geyer et al. | 123/90.55 |
| 7,210,439 | B2 | 5/2007 | Geyer et al. | 123/90.55 |
| 7,246,587 | B2 | 7/2007 | Evans et al. | 123/90.52 |
| 2001/0009145 | A1 | 7/2001 | Faria et al. | 123/90.16 |
| 2002/0038642 | A1 | 4/2002 | Haas et al. | 123/90.48 |
| 2002/0195072 | A1 | 12/2002 | Spath et al. | 123/90.16 |
| 2003/0070636 | A1 | 4/2003 | Evans et al. | 123/90.5 |
| 2003/0075129 | A1 | 4/2003 | Spath et al. | 123/90.16 |
| 2003/0101953 | A1 | 6/2003 | Hendriksma et al. | 123/90.16 |
| 2005/0005884 | A1 | 1/2005 | Geyer et al. | 123/90.16 |
| 2005/0081811 | A1 | 4/2005 | Spath et al. | 123/90.48 |
| 2005/0103300 | A1 | 5/2005 | Spath et al. | 123/90.59 |
| 2005/0120989 | A1 | 6/2005 | Geyer et al. | 123/90.59 |
| 2006/0191503 | A1 | 8/2006 | Geyer et al. | 123/90.15 |
| 2006/0225682 | A1 | 10/2006 | Evans et al. | 123/90.59 |

FOREIGN PATENT DOCUMENTS

| | | | |
|---|---|---|---|
| DE | 43 32 660 | A1 | 3/1995 |
| DE | 43 33 927 | A1 | 4/1995 |
| DE | 195 02 332 | A1 | 8/1996 |
| DE | 198 04 952 | A1 | 8/1999 |
| DE | 198 44 202 | A1 | 3/2000 |
| DE | 199 15 531 | A1 | 10/2000 |
| DE | 199 15 532 | A1 | 10/2000 |
| DE | 199 19 245 | A1 | 11/2000 |
| EP | 0 318 151 | A1 | 5/1989 |
| EP | 0 608 925 | B1 | 8/1996 |
| EP | 1 149 989 | A1 | 10/2001 |
| GB | 574 852 | A | 1/1946 |
| GB | 2 272 022 | | 5/1994 |
| WO | WO 9530081 | A1 | 11/1995 |

OTHER PUBLICATIONS

Quan Zheng, "Characterization of the Dynamic Response of a Cylinder Deactivation Valvetrain System" Society of Automotive Engineers, Inc. SAE Technical Paper Series, Mar. 2001, pp. 195-201.

K. Hampton, Eaton VRRS System, Society of Automotive Engineers, Inc., Variable Value Actuation TOPTEC®: The State of the Art, Sep. 11-12, 2000, 27 pages.

Buuk, B. et al., "Engine Trends and Valve Train Systems for Improved Performance and Fuel Economy", Eaton Corporation—Engine Components Operations, USA, pp. 1-9 (Aug. 1999).

Fortnagel, M. et al., Four Made of Eight—The New 4.31 and 5.01 V8 Engines, Mercedes-Benz S-Class, pp. 58-62 (1997).

Sandford, M. et al., "Reduced Fuel Consumption and Emission Through Cylinder Deactivation", Aachener Kolloquium Fahrzeug- und Motorentechnik, pp. 1017-1027 (1998).

Chrysler Group, "Design Practice Standards", Paper dated Mar. 15, 2005, 1 page, in German with English Translation (2 pages).

* cited by examiner

SWITCHING ELEMENT FOR A VALVE TRAIN OF AN INTERNAL COMBUSTION ENGINE

This application is a National Stage filing under 35 U.S.C. § 371 of International Application No. PCT/EP03/00307, filed Jan. 15, 2003, which in turn claims priority of both German Application No. DE 102 04 672.7, filed Feb. 6, 2002, and U.S. Provisional Patent Application No. 60/354,628, filed Feb. 6, 2002, the priorities of each of which is hereby claimed, said International Application having been published in German, but not in English, as International Publication No. WO 03/067038 A1.

BACKGROUND OF THE INVENTION

1. Field of the Invention

The invention concerns a switching element for a valve train of an internal combustion engine, preferably for valve deactivation, having an outer part and an inner element that is axially displaceable in a bore therein, wherein the outer part and the inner element each have at least one receptacle aligned with each other in an axially separated relative position achieved by a lost motion spring, wherein one or more movable coupling means for coupling the inner element with the outer part are applied in one of the receptacles toward the other receptacle in their positions relative to one another, wherein a first upper stop for defining the relative position is applied between the inner element and the outer part, and wherein a hydraulic lash adjuster with a pressure piston is installed in the inner element, which pressure piston is fixed against moving axially out of the inner element by a second upper stop.

2. Description of the Related Art

A switching element of this type is disclosed in DE 199 15 531 that is considered generic. This switching element is shown as a switchable cam follower for a tappet push rod drive. An upper stop for defining the relative position is realized through a piston-like element arranged in the inner element. This piston-like element projects radially outward into a longitudinal groove of the outer part. In the axially extended state of the inner element relative to the outer part, the piston-like element contacts an end of the longitudinal groove. The aim of this is to achieve an aligned positioning of a coupling bore provided in the outer part and a piston arranged in the inner element for coupling.

A drawback of this prior art is that adjustment of lash in the coupling is relatively complicated and expensive. It is clear that the receptacle in the outer part (here a coupling bore) for receiving the piston must be designed with a slight lash relative to the outer peripheral surface of the piston. This lash and a vertical position vary from one switching element to the other depending on the manufacturing conditions. The relatively broad range of variation of this mechanical free travel in the switching elements is, however, not desirable.

Therefore, to adjust the coupling lash or keep its variance within an acceptable range, the pistons are classified for locking purposes in groups. This is extremely complicated and expensive from the manufacturing and measuring point of view. For example, switching elements must be completely assembled, the lash then measured, following which the switching element must again be disassembled and mated to a suitable coupling piston. It is equally conceivable to classify the upper stops on the longitudinal groove of the outer element.

Another upper stop is provided in the aforesaid prior art for a pressure piston of the lash adjuster and is configured as a ring.

If two pistons are provided for coupling, as is the case in DE 4,206,166, the aforesaid stop measures prove to be nearly impossible. The aligned position of the coupling bores situated diametrically opposite each other in the inner element is realized when the two axially movable parts of the switching element make contact with the base circle of the cam. An adjustment of the coupling lash in this case is accomplished by extremely complicated manufacturing and measuring techniques by pairing suitable switching elements (in this case, cup tappets) with cam pairs or camshafts. Under certain circumstances, it is necessary to tolerate an excessive lash variation.

Thus, the object of the invention is to provide a switching element of the aforementioned type in which the stated drawbacks are eliminated by simple means.

SUMMARY OF THE INVENTION

This object is achieved in accordance with the invention in that each of the upper stops is designed as at least one annular element such as a retaining ring and the upper stops are arranged on top of each other in the bore of the outer part, wherein as seen when looking into the bore of the outer part, the lower retaining ring forms the second upper stop and the first retaining ring, located above it, forms the first upper stop, wherein variable-thickness first retaining rings and constant-thickness second retaining rings are provided at assembly of the retaining rings, and wherein the retaining ring stack contacts a stop such as an annular shoulder of the bore with the first retaining ring out of the bore.

Due to the at least two, or two retaining rings, as the case may be, a simple, tilt-free and adjustable upper stop and, at the same time, a safety device against loss of the pressure piston of the hydraulic lash adjuster is obtained. Preferably, two coupling means (pistons) are provided in the inner element. However, the invention applies equally to embodiments with only one piston or with a plurality of pistons.

The subordinate claim 1 refers alternatively to a method for adjusting the coupling lash in a switching element according to the features of the preamble to claim 1.

The aforementioned means overcome the aforesaid drawbacks by simple means and effectively. On the one hand, it is ensured that the pressure piston of the lash adjuster and thus also the inner element cannot be lost (second upper stop) during the assembly of the switching element. On the other hand, the stocking of variable-thickness first rings as first upper stops is a very simple option for adjusting the free travel of the at least one coupling element (piston) relative to its surrounding receptacle. This free travel is preferably adjusted such that each receptacle surrounds the relevant coupling element with equal spacing in both axial directions. If the receptacle is a bore and not an annular groove, it is particularly advantageous if the bore surrounds the relevant coupling element concentrically.

In place of the retaining rings here, a person skilled in the art will conceive of other easy-to-install stop elements such as discs, insertable pins, wedges, rings, etc. Of course, these elements may also be arranged at other height levels than on the edge of the switching element. If need be, a plurality of retaining rings can be paired to realize the coupling lash or the anti-loss device.

It is thus guaranteed that, in the relevant coupling situation, the coupling means of a large number of switching elements will always traverse the same free travel in the surrounding receptacle of the outer part.

As mentioned above, the coupling means is provided preferably in the form of two pistons that extend in the receptacle, designed as a radial bore, in the inner element where they are situated diametrically opposite each other. This is a particularly tilt-resistant mechanism that produces only a slight component loading when coupled. In place of the radial bore in the inner element, it is also conceivable to use a blind bore or another similar feature.

As a further development of the invention it is proposed, as already mentioned, to manufacture the receptacle of the outer part in the form of an annular groove in its bore. This is particularly advantageous from the manufacturing point of view. Bores may also be used in place of the annular groove.

According to a further advantageous embodiment of the invention, the inner element is secured against rotation relative to the outer part, for instance by a pin-like element. In this way, the coupling means has the same position relative to its receptacle over the entire operating life of the switching element as at the adjustment of the coupling lash. As a result, tolerances no longer have any effect when the receptacle is configured as an annular groove.

It is further proposed in the case where two pistons are used as a coupling means, to have the annular groove intersected by two diametrically opposite oil passages such as bores. If two ducts situated opposite each other are provided for the switching element in an oil gallery of a surrounding structure, for example, a cylinder head or a guide for the switching element connected to the internal combustion engine, it is of no importance which oil passage of the switching element communicates with which duct. What is important for achieving the same switching times is that the oil paths have the same length. However, if there is only one duct, a properly oriented installation of the switching element is required. In this case, appropriate markings can be provided on the switching element to facilitate assembly. Of course, the oil passages in the outer part may also be arranged on another peripheral portion of the outer part so that they are not aligned to the pistons in the coupled state.

In the event that the switching element is manufactured as a cam follower in a tappet push rod drive, as proposed in another useful further development of the invention, and this cam follower has a roller as a cam-contacting element, it is necessary, also for a correct allocation of the ducts from the ambient structure to the oil passages, to secure the switching element against rotation. Appropriate anti-rotation devices such as flattened portions on the outer peripheral surface of the outer part are proposed in this connection.

Other elements such as latches, balls, wedges or similar elements that produce a positive engagement may also be used as a coupling means in place of the pistons. If necessary, a combination of positive engagement and force-locking is also feasible.

The scope of protection of this invention extends explicitly to all kinds of switching elements in valve trains such as the aforesaid cam followers in tappet push rod drives, cup tappets or support elements for drag levers, etc.

BRIEF DESCRIPTION OF THE DRAWINGS

The invention will now be explained more closely with reference to the drawing in which.

DETAILED DESCRIPTION

Figure 1:
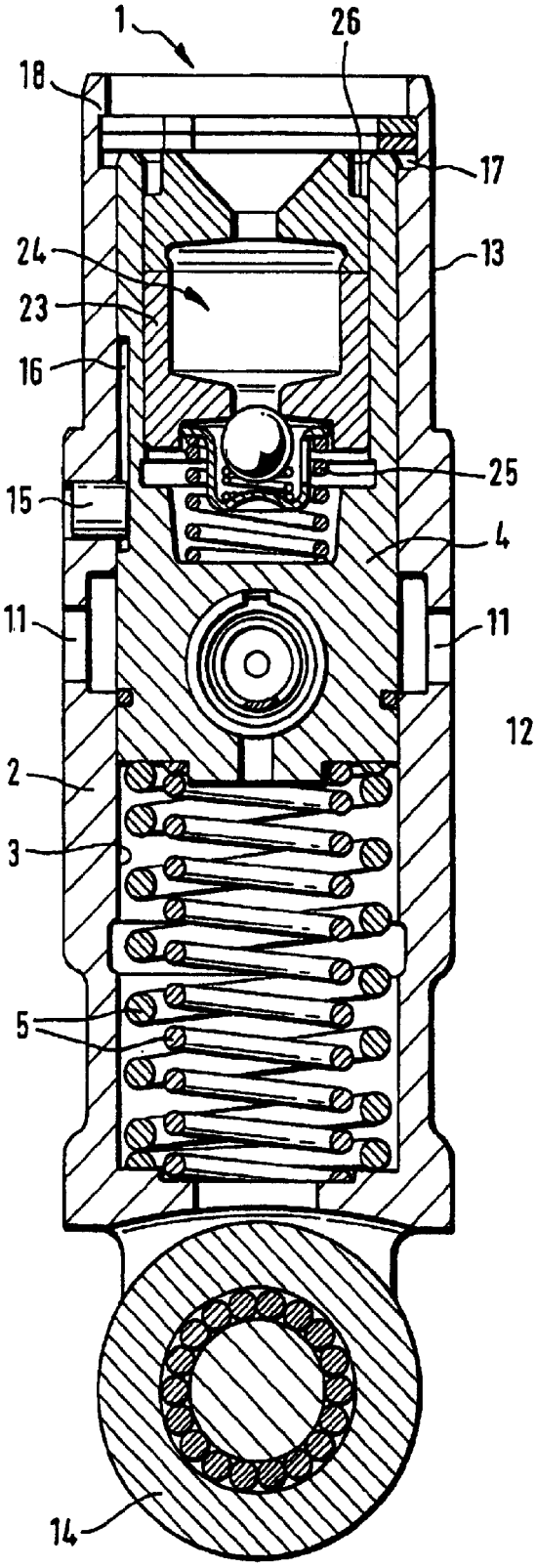
FIG. 1 shows a longitudinal section through a switching element embodied as a roller tappet for a tappet push rod drive.
Figure 2:
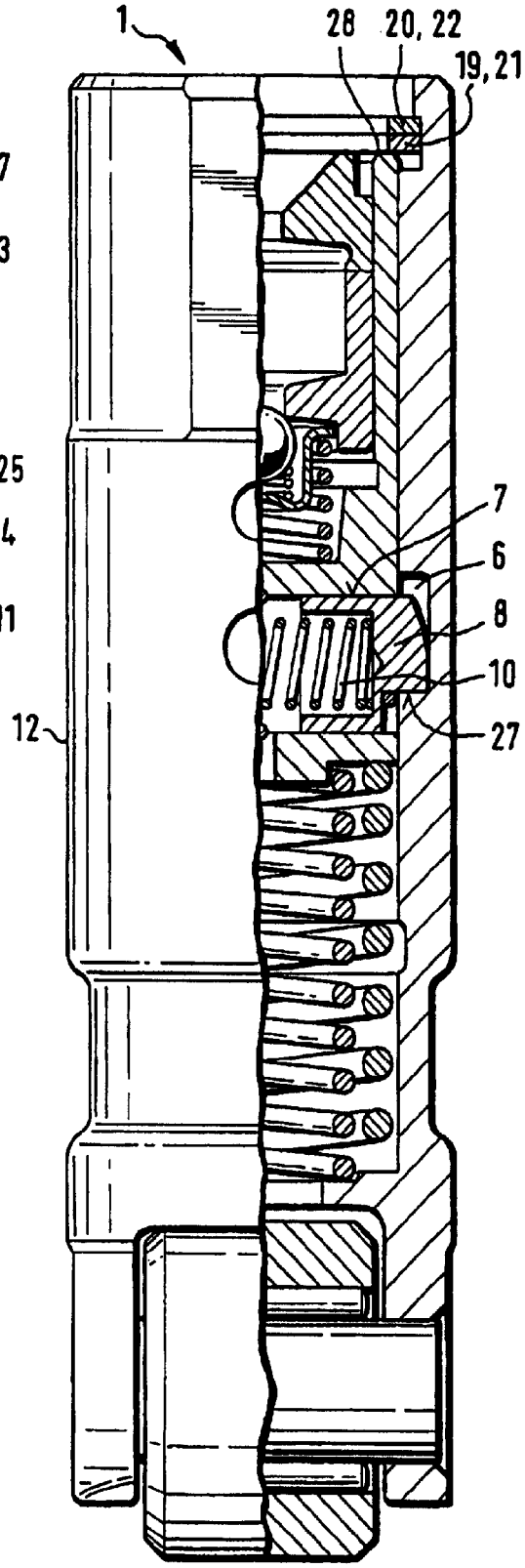
FIG. 2 shows a partial longitudinal section of the switching element of FIG. 1 rotated by 90°.

FIGS. 1 and 2 disclose a switching element 1 for a valve train of an internal combustion engine. The switching element 1 is configured in this case as a roller tappet for a tappet push rod drive and comprises an outer part 2 having a bore 3 in which an axially movable inner element 4 extends. The inner element 4 and the outer part 2 are forced apart from each other by a lost motion spring 5, not requiring further explanation here.

In the illustrated axially separated position of the outer part 2 relative to the inner element 4, the receptacles 6, 7 thereof are aligned to each other. The receptacle 6 of the outer part 2 is manufactured as a circumferential annular groove. The receptacle 7 in the inner element 4, in contrast, is designed as a radially extending through-bore. Arranged herein are two diametrically opposite coupling means 8, embodied here as pistons. The coupling means 8 are forced radially outwards (coupling direction) through the force of a compression spring 10. In the radially inward direction i.e., in the uncoupling direction, the coupling means 8 can be displaced by means of hydraulic medium. For this purpose, the outer part 2 appropriately has two oil passages 11 situated diametrically opposite each other (see FIG. 1). These passages 11 are configured in the present case as bores and offset by 90° to the coupling means 8 in the circumferential direction. In useful fashion, the oil passages 11 communicate with two hydraulic medium ducts from surrounding structure, not explained further here.

A person skilled in the art will further see in the figures that means 13 for preventing rotation are provided on the outer peripheral surface 12 of the outer part 2. These means 13 are designed here as opposite flattened portions. This measure proves to be necessary, firstly, in order to connect the oil passages 11 to their respective ducts and, secondly, in order to properly align a roller 14 with respect to a cam, not shown.

It can be seen further that the inner element 4 is likewise secured against rotation relative to the outer part 2. For this purpose, an anti-rotation device 15 (embodied here as a pin) is fixed in the outer part 2 and projects radially into the bore 3 of the outer part 2. The inner element 4, in turn, has a longitudinal recess 16 facing the anti-rotation device 15 on the flanks of which the anti-rotation device 15 is guided.

The outer part 2 has, in a region distant from the bore, an annular groove 17 with a stop 18. Two retaining rings 19, 20 are snapped into the annular groove 17. These rings form a second and a first upper stop 21, 22, respectively. As a whole, the retaining rings 19, 20 bear against the stop 18. The second, lower retaining ring 19 serves as an anti-loss device of a pressure piston 23 of a hydraulic lash adjuster 24 that is installed in the inner element 4. An adjustment of the coupling lash of the coupling means 8 in the surrounding receptacle 6 is achieved by means of the first retaining ring 20 that is situated on the second retaining ring 19 and is stocked in different thicknesses during assembly.

It is clear that, after installation of the second retaining ring 19, the pressure piston 23 together with the inner element 4 can no longer be pushed out of the bore 3 of the outer part 2 by the force of a compression spring 25 of the lash adjuster 24 or by the force of the lost motion spring 5. The pressure piston 23 thus bears against the second retaining ring 19 through its edge 26.

Before the coupling lash of the coupling means 8 relative to their receptacle 6 can be adjusted, it is necessary to determine this lash. This is done with the coupling means 8 extended. In doing so, to put it simply, after loading of the inner element 4 and hence its displacement in the bore 3 until a lower surface 27 of the receptacle 6 is reached, the free travel of the coupling means 8 in the receptacle 6 is measured. For a person skilled in the art it is then relatively simple to calculate, on the basis of the measured free travel, the height at which a central position of the coupling means 8 in the receptacle 6 is reached. When this value has been established, a first retaining ring 20 of appropriate thickness is snapped into the annular groove 17 directly above the second retaining ring 19. The lost motion spring 5 thus presses the inner element 4 with its edge 28 against the second retaining ring 19. In this position (coupling position), the adjustment of the coupling lash is completed, advantageously in such a manner that the coupling means 8 has an equally short traveling path in both axial directions within the receptacle 6.

To sum up, the free travel that the inner element 4 traverses relative to the outer part 2, with the coupling means 8 in the receptacles 6, after successful coupling with the outer part 2 and upon commencement of cam loading, is kept uniformly small by means of a series of switching elements 1 in internal combustion engines of the same type. Excessive and undesirable variation in valve timings is precluded.

REFERENCE NUMERALS

1 Switching element
2 Outer part
3 Bore
4 Inner element
5 Lost motion spring
6 Receptacle of outer part
7 Receptacle of inner part
8 Coupling means
9 not used
10 Compression spring
11 Oil passage
12 Outer peripheral surface
13 Means
14 Roller
15 Anti-rotation device
16 Longitudinal recess
17 Annular groove
18 Stop
19 Retaining ring
20 Retaining ring
21 Upper stop
22 Upper stop
23 Pressure piston
24 Lash adjuster
25 Compression spring
26 Edge of pressure piston
27 Lower surface
28 Edge of inner element

What is claimed is:

1. A method of adjusting coupling lash in a switching element for a valve train of an internal combustion engine, preferably for valve deactivation, having an outer part and an inner element that is axially displaceable in a bore therein, wherein the outer part and the inner element each have at least one receptacle aligned with each other in an axially separated relative position achieved by a lost motion spring, wherein one or more movable coupling means for coupling the inner element with the outer part are applied in one of the receptacles toward the other receptacle in their positions relative to one another, wherein a first upper stop for defining the relative position is applied between the inner element and the outer part, and wherein a hydraulic lash adjuster with a pressure piston is installed in the inner element, which pressure piston is fixed against moving axially out of the inner element by a second upper stop, characterized in that each of the upper stops is designed as at least one annular element such as a retaining ring and the upper stops are arranged on top of each other in the bore of the outer part, wherein as seen when looking into the bore of the outer part, the lower retaining ring forms the second upper stop and the first retaining ring, located above it, forms the first upper stop, wherein variable-thickness first and constant-thickness second retaining rings are provided at assembly of the retaining rings, and wherein the retaining ring stack contacts a stop such as an annular shoulder of the bore with the first retaining ring out of the bore, wherein provided as the upper stop in each case is at least one annular element such as a retaining ring, the bore of the outer part has a stop distant from the bore such as an annular shoulder, and as coupling means at least one piston is provided, which extends in the receptacle that is embodied as a radial bore of the inner element, having the following steps, which may also be supplemented with additional intermediate steps:

a) snapping-in of the at least one second retaining ring into a region axially below the stop in such a way that the bore-distant edge of the pressure piston of the lash adjuster is pressed by the force of a compression spring of the lash adjuster against the second retaining ring and the latter is pressed against the stop;

b) displacement of the inner element in the direction of the bore, with the coupling means extended in the receptacle of outer part, until the coupling means comes to bear against a lower surface of the receptacle;

c) measurement of the free travel traversed by the inner element with the coupling means to the point of contact with the lower surface, and d) pairing of the at least one first retaining ring having such a thickness that, upon its subsequent snapping-in to a region axially below the stop, in contact with the second retaining ring, the inner element is displaced by the second retaining ring such that the coupling means extends at an equal distance from the receptacle at least in both axial directions.

2. A method for setting the mechanical lash to a predetermined desired value in a valve-deactivating lifter having a pin housing disposed in a lifter body wherein the housing is retained in the body by a retaining ring disposed in a retainer groove in the lifter body and extends radially inwards of an inner wall of said body, the pin housing having locking pins slidably disposed in a transverse bore for engaging a circumferential groove in the lifter body, said circumferential groove having a locking surface, comprising the steps of:

a) installing said pin housing into said lifter body;

b) engaging said locking pins with said circumferential groove;

c) installing said retaining ring into said retainer groove;

d) biasing said pin housing against said retaining ring;

e) measuring a clearance between said locking pins and said locking surface;

f) numerically subtracting a predetermined desired clearance value from said measured clearance to obtain a first numerical difference;

g) selecting a spacer having a thickness equal to said first numerical difference; and h) installing said selected spacer in said retainer groove adjacent said retaining ring to yield said predetermined desired clearance (lash) in said lifter.

* * * * *